US005766083A

United States Patent [19]

Autrey

[11] Patent Number: 5,766,083

[45] Date of Patent: Jun. 16, 1998

[54] HARNESS ASSEMBLY FOR SUSPENDING A PERSON IN A SUPINE POSITION

[76] Inventor: Thie Autrey, 236 Regal Dr., Lawrenceville, Ga. 30245

[21] Appl. No.: 764,624

[22] Filed: Dec. 11, 1996

[51] Int. Cl.[6] ..... A63G 9/00

[52] U.S. Cl. ..... 472/118; 472/133

[58] Field of Search ..... 472/118, 133, 472/135, 136, 137, 80, 49, 50; 5/89.1, 81.1 T, 85.1, 87.1, 625, 627, 628

[56] References Cited

U.S. PATENT DOCUMENTS 616,282 12/1898 Allen .
1,182,492 5/1916 Knowles .
1,482,554 2/1924 Gundlach .
4,736,474 4/1988 Moran et al. ..... 5/82 R
5,267,906 12/1993 Kitchen et al. .
5,427,576 6/1995 Pfeiffer .
5,527,223 6/1996 Kitchen et al. .

*Primary Examiner*—Kien T. Nguyen
*Attorney, Agent, or Firm*—Cushman Darby & Cushman Intellectual Property Group of Pillsbury Madison & Sutro, LLP

[57] ABSTRACT

A harness assembly that suspends a rider in a supine position. The harness assembly includes a body portion that is worn by the rider. A suspension assembly is coupled to the body portion for suspending the person in the body portion above ground. A grappling assembly is coupled to the body portion to facilitate grasping thereof by an external grappling member. A head support is provided for supporting the rider's head when in the supine position.

26 Claims, 6 Drawing Sheets

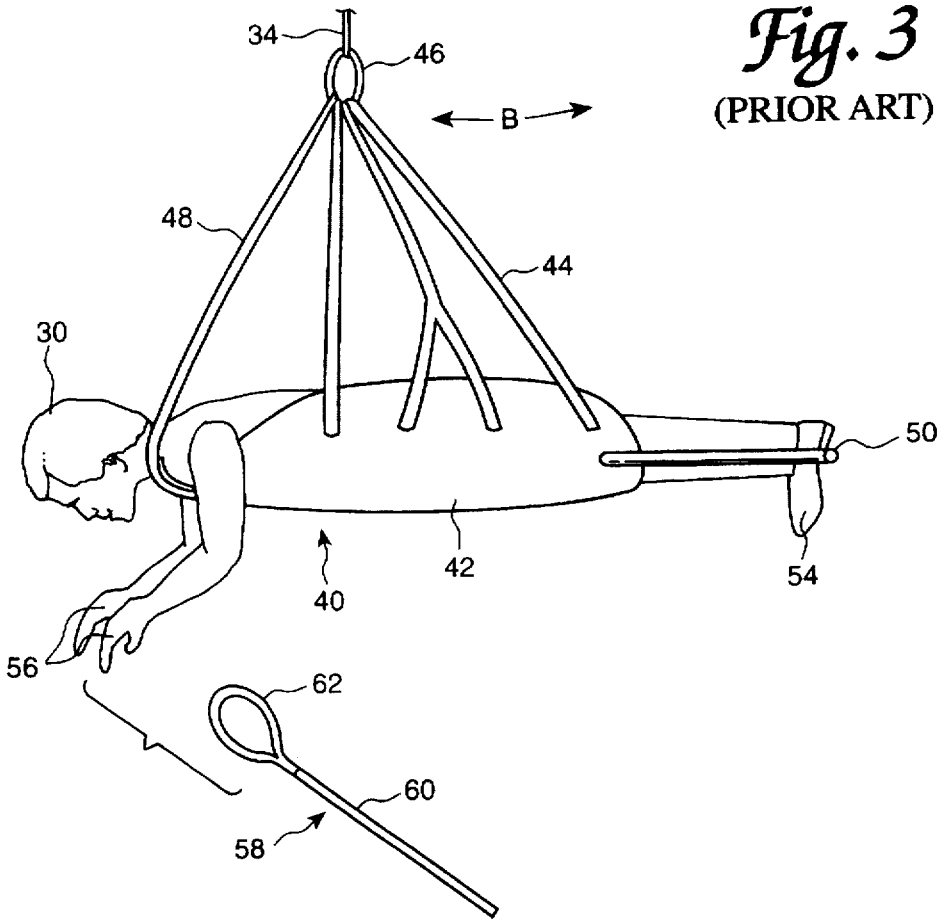
Fig. 3
(PRIOR ART)
Fig. 4
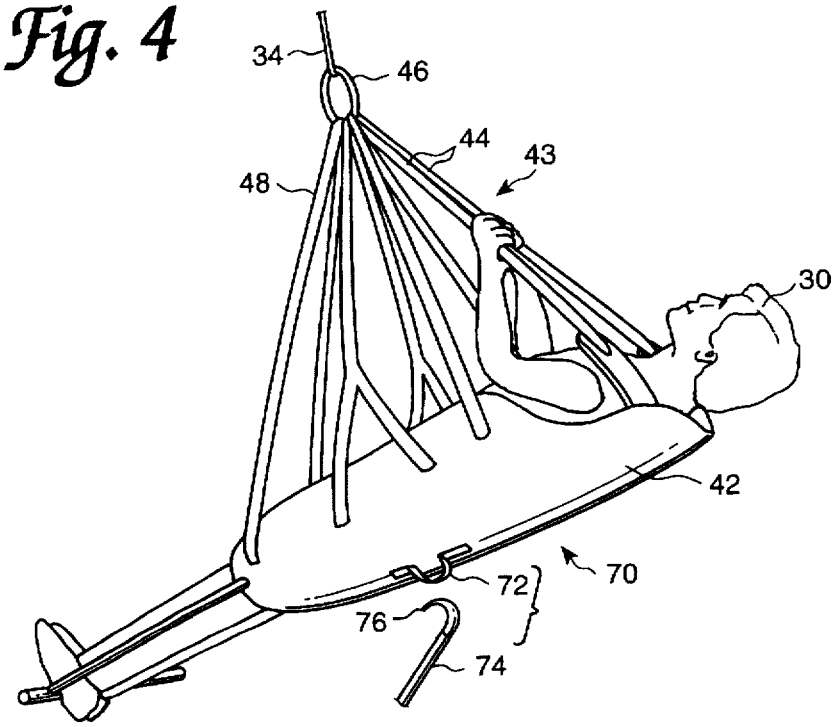

HARNESS ASSEMBLY FOR SUSPENDING A PERSON IN A SUPINE POSITION

BACKGROUND OF THE INVENTION

1. Field of the Invention

This invention pertains to a harness assembly for use in a swing-type amusement ride, and, in particular, to a harness assembly that attaches a person to the swing-type amusement ride so that the person can experience the ride while in a supine position.

2. Description of the Related Art

FIG. 1 illustrates a conventional swing-type amusement ride wherein a rider 30 is suspended from a support structure 32 via a suspension line 34 attached thereto. The rider is placed in a harness which is initially attached to suspension line 34 and to a hoisting line 36. Hoisting line 36 is attached to a launch structure 38. The ride begins by hoisting rider 30 off the ground by drawing hoisting line 36 toward launch structure 38. When rider 30 is hoisted to the launch position, as illustrated in FIG. 1, hoist line 36 is disengaged from the harness so that rider 30 swings toward support structure 32 on suspension line 34. In the illustrated embodiment, rider 30 swings between the legs of support structure 32. Gravity causes rider 30 to swing in a pendulum-like manner from support structure 32 until being stopped by the operators of the amusement ride.

A conventional harness assembly 40 used to suspend rider 30 from support line 32 is illustrated in FIG. 2. Harness assembly 40 includes a body portion 42 worn by the rider and a suspension assembly 43. Suspension assembly 43 is attached to body portion 42 and to suspending line 34 for suspending the rider therefrom. In particular, suspension assembly 43 includes a plurality of straps 44 attached at one end to body portion 42 and at an opposite end to a ring 46. These straps include a pair of shoulder straps 48 at the portion of body portion 42 where the rider's head is located. In addition, a foot bar 50 is located at the opposite end of body portion 42 and is attached thereto via foot straps 52. The bottom of the rider's feet rest against foot bar 50 when harness assembly 40 is properly worn by the rider.

In the conventional amusement ride, rider 30 lies face down on body portion 42 such that the rider's feet 54 are against foot bar 50 and the rider's chest is adjacent to the inner surface of body portion 42 as illustrated in FIG. 3. In this position, the rider's hands 56 are free to dangle in front of the riders body in a natural position.

Stopping the rider at the end of the ride is accomplished by having the rider grasp a grappling member 58 held by the amusement ride operator (not shown). See FIG. 3. Once both the rider and operator are grasping grappling member 58, the operator applies a force on the grappling member so as to slow the pendulum-like motion of rider 30 as he or she swings back and forth, as indicated by arrow B in FIGS. 2 and 3. After being sufficiently slowed, the rider is then safely lowered to the ground or a landing platform and removed from the harness assembly.

Grappling member 58 includes a body portion 60 and a loop 62 attached to one end thereof. Typically, loop 62 is a rope wrapped with a plastic cover and body portion 60 is a piece of tubing, such as PVC tubing.

U.S. Pat. Nos. 5,267,906 and 5,527,223 both to Kitchen et al., the contents of which are incorporated hereby by reference, disclose examples of the conventional swing-type amusement ride, including the support and launch structures, harness assembly, and grappling member.

SUMMARY OF THE INVENTION

While the above-described conventional configuration for a swing-type amusement ride provides a certain degree of thrill as the rider swings in a face-down position from the launch point, the present inventor recognized that some riders may wish to vary the manner in which they are suspended from the support structure, thereby enhancing the level of thrill associated with the amusement ride. As one unique way of riding the ride, the inventor contemplates placing rider 30 in a supine position in a harness assembly so that the rider is facing in a direction opposite that illustrated in FIG. 3.

The inventor further recognized, however, that when the amusement ride is ridden in this fashion, additional measures must be taken to enable the amusement ride operator to stop the motion of the rider during landing. In particular, the inventor recognized that the conventional grappling member is not effective when the rider is in the supine position because if the rider grabs loop 62 on conventional grappling member 60 while in a supine position, the rider's arms will tend to be pulled backward toward the riders back, which is not a natural position for a person's arms. Therefore, there is a chance that the rider's arms will be pulled so as to cause injury to the rider during landing if stopped in the conventional manner.

The inventor further recognized that the gravitational forces experienced by the rider when riding in a supine position tend to pull the rider's head backward. This can cause undesirable strain on the rider's neck or a possible injury thereto.

It is an object of the present invention to provide a harness assembly for a swing-type amusement ride that permits greater flexibility in the manner in which the rider can experience the ride. It is a further object of the invention to provide a harness assembly that includes a grappling assembly that is adapted to be grasped by the amusement ride operator during landing, thereby slowing down the pendulum-like motion of the rider, even if the rider is unable to assist in the landing operation.

It is a still further object of the present invention to provide a harness assembly that supports the rider's head so that the rider can comfortably experience the swing-type amusement ride while in a supine position in the harness assembly.

These and other objects of the present invention are achieved by providing a harness assembly that is adapted to suspend a person in a supine position. The harness assembly includes a body portion adapted to be worn by the rider. A suspension assembly is coupled to the body portion for attaching the body portion to a support line on the swing-type amusement ride. In addition, the harness assembly includes a grappling assembly coupled to the body portion that facilitates grasping of the body portion by an external grappling member so that the motion of the rider can be safely slowed during landing without the assistance of the rider.

In addition, the harness assembly of the present invention includes a head support member coupled to at least one of the body portion and the suspension assembly to support the head of the person wearing the harness.

Other objects, features, and characteristics of the present invention, as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 3 is a perspective view illustrating a rider in the harness assembly of FIG. 2 as well as the manner in which the rider's motion is slowed during landing;

FIG. 4 is a perspective view illustrating a harness assembly and a grappling member according to the present invention;

DETAILED DESCRIPTION OF THE PRESENTLY PREFERRED EXEMPLARY EMBODIMENTS

Figure 1:
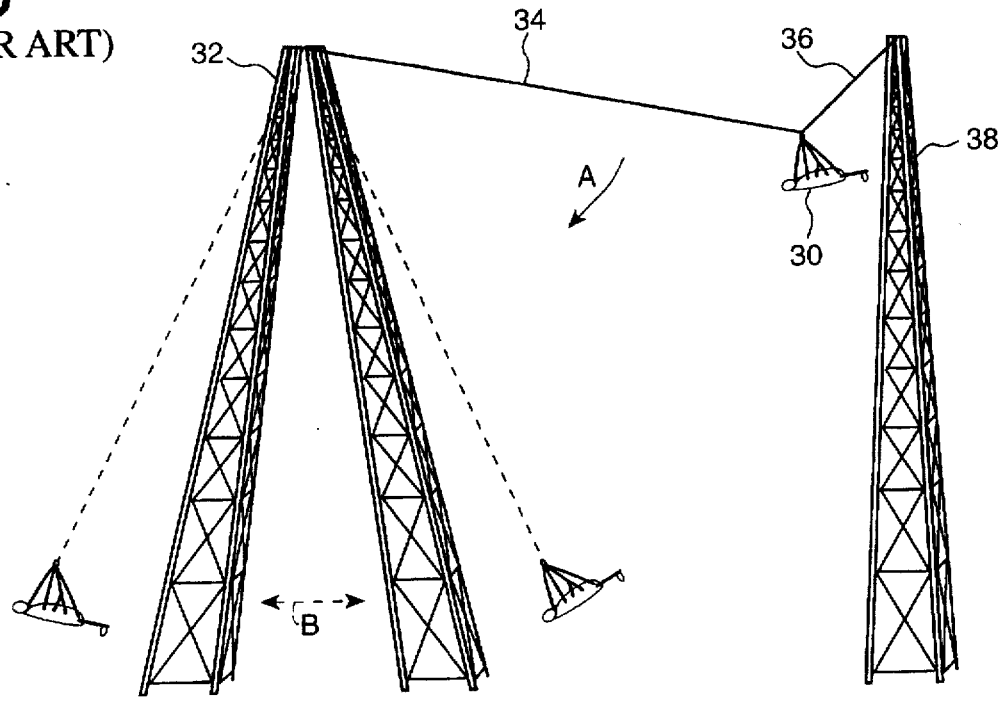
Fig. 1 (PRIOR ART)
FIG. 1 illustrates a conventional swing-type amusement ride.
Figure 2:
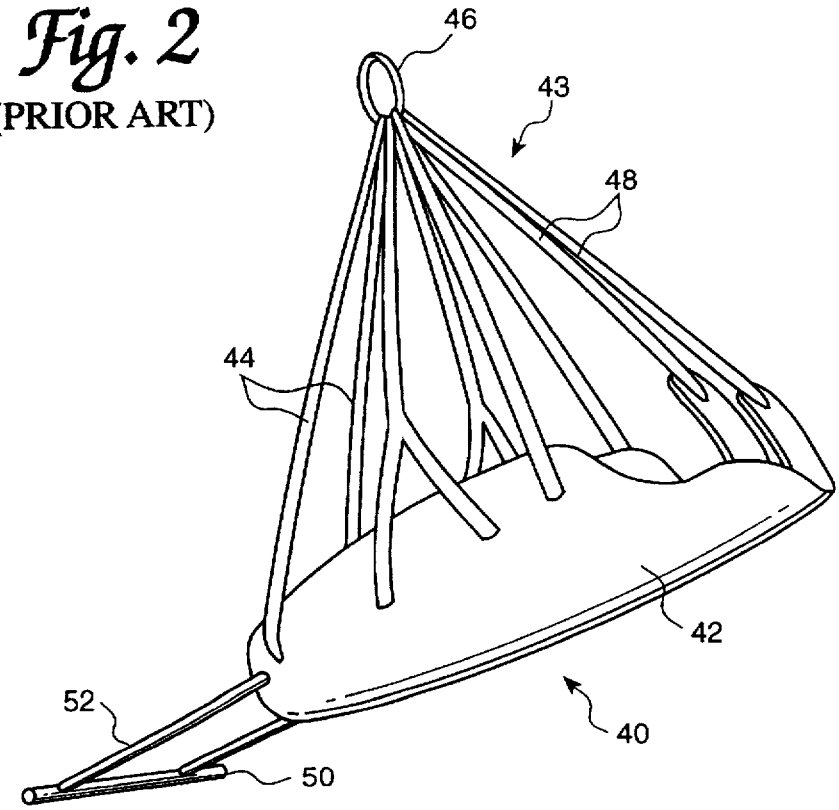
Fig. 2 (PRIOR ART)
FIG. 2 is a perspective view illustrating a conventional harness assembly for use in the swingtype amusement ride of FIG. 1.

FIG. 4 illustrates a harness assembly 70 according to the principles of the present invention. The features of harness assembly 70 common to conventional harness assembly 40 illustrated in FIGS. 2 and 3 are identified with like reference numerals.

Harness assembly 70 includes a body portion 42 that supports rider 30 in a supine position, as shown in FIG. 4. In this position, the rider lies so as to generally face support assembly 43 that connects body portion 42 to support line 34 via ring 46. To enable the amusement ride operator to stop rider 30 from continuing to swing in a pendulum-like manner after launch, harness assembly 70 includes a grappling assembly in the form of a strap 72 attached to the exposed underside of body portion 42.

In the illustrated embodiment, strap 72 is attached in a lengthwise direction on body portion 42 such that a loop extends from body portion 42 thereby providing a mechanism by which the operator can grasp harness assembly 70. In a presently preferred embodiment of the invention, strap 72 is retrofitted onto a conventional harness assembly by being sewn thereon.

Figure 5:
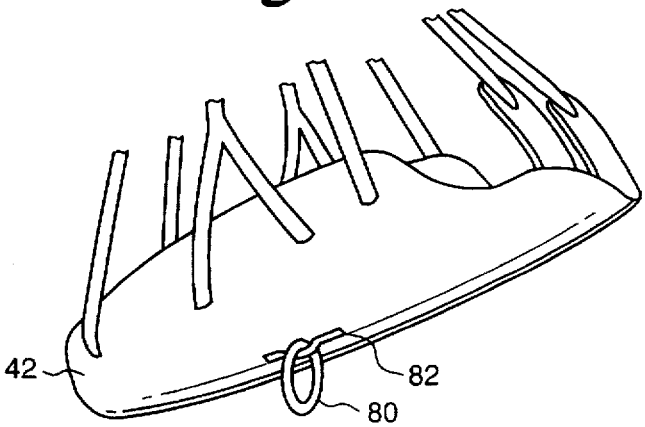
FIG. 5 is a perspective view illustrating a modification of the harness assembly according to the present invention.

FIG. 5 illustrates a variation of the grappling assembly attached to body portion 42. For the sake of clarity, detailed features, such as the foot support assembly shown in the previous figures, are not illustrated in FIG. 5. In this embodiment, a loop 80 is attached to the underside of body portion 42 via a small strap 82. The present invention contemplates that loop 80 can be made from a variety of types of materials, such as fabric or metal, or composites of materials so long as the material or composite used is strong enough to permit grappling thereto and to enable slowing of the motion of the rider 30 suspended in the harness assembly. The present invention further contemplates that loop 80 can have a variety of configurations and is by no means limited to the circular shape shown in FIG. 5.

In the embodiment illustrated in FIG. 5, loop 80 is attached to body portion 42 along a center line thereof via strap 82. It is to understood, however, that loop 80 can be attached to body portion 42 via strap 82 at a variety of positions. In the embodiment illustrated in FIG. 5, loop 80 is permanently attached to body portion 42 via strap 82. However, the present invention also contemplates that loop 80 can be selectively attached to body portion 42 via an attaching assembly.

Figure 6:
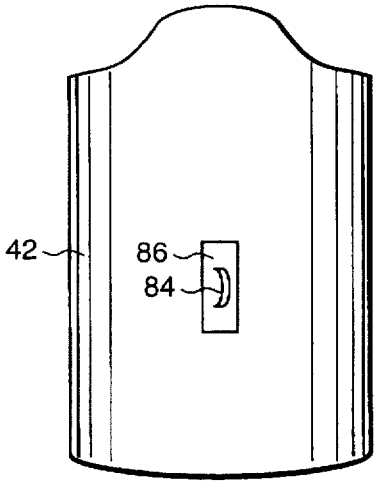
FIG. 6 is a bottom view of a body portion of a harness assembly illustrating another alternative configuration of the present invention.
Figure 7:
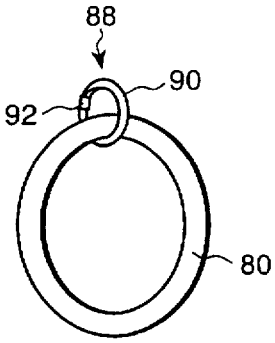
FIGS. 7 and 8 are perspective views illustrating a grappling loop that attaches to the body portion illustrated in FIG. 6.
Figure 8:
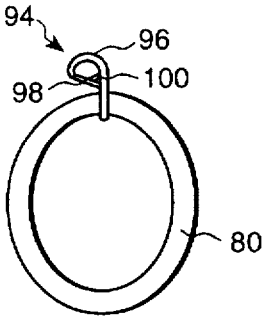

FIGS. 6–8 illustrate various structures for selectively attaching loop 80 to the underside of body portion 42. As shown in FIG. 6, a small attaching loop 84 is affixed to the underside of body portion 42. In this embodiment, a strap 86 attaches attaching loop 84 along the center line of body portion 42. Grappling loop 80 is selectively attached to attaching loop 84 by means of a selectively openable and closable locking hook. Two embodiments of a locking hook suitable for use in this invention are illustrated in FIGS. 7 and 8.

As shown in FIG. 7, a locking hook 88 includes a small ring 90 and a circular member 92 that selectively opens and closes a gap provided in ring 90. Twisting circular member 92 in a first direction moves member 92 relative to ring 90 so as to open the gap, thereby permitting ring 90 to be attached to attaching ring 84. Twisting circular member 92 in an opposite direction closes the gap thereby locking ring 90, including loop 80, to attaching ring 84.

In FIG. 8, a locking hook 94 includes a hook member 96 with a bar 98 selectively disposed across an opening of hook member 96. Bar 98 is biased by a spring 100 into a closed position to prevent an object disposed within hook member 96 from being removed through the opening thereof. With this configuration, hook member 96 can be selectively attached and locked to attaching loop 84 via bar 98.

The present invention further contemplates that loop 82 can be structured so as to be selectively attachable directly onto an attaching assembly, such as strap 82 in FIG. 5, without using a separate locking hook. For example, a selectively openable gap can be provided in loop 80 that is selectively opened and closed by a locking mechanism, such as that illustrated with respect to the locking hook of FIG. 7.

Figure 9:
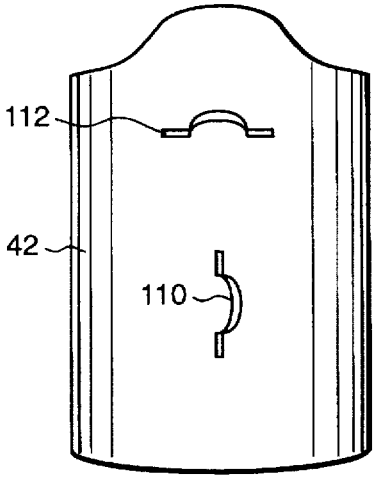
FIGS. 9 and 10 are a bottom views of a body portion illustrating variations of the grappling assembly associated with the harness assembly according to the present invention.

In addition to a harness assembly having one strap attached to the bottom of body portion 42, the present invention contemplates that a plurality of straps having a variety of configurations can be attached to body portion 42 in a variety of locations to facilitate grasping of the harness assembly by a grappling member. FIG. 9 illustrates two such straps disposed in a 90° orientation with respect to one another.

Strap 110 is provided in a lengthwise direction along a center line of body portion 42. Strap 112 is provided in a direction generally perpendicular to the center line and affixed so as to be symmetrically disposed about the center line of body portion 42. The configuration in FIG. 9 is advantageous in that it provides more grappling surfaces to which a grappling member can be attached.

Figure 10:
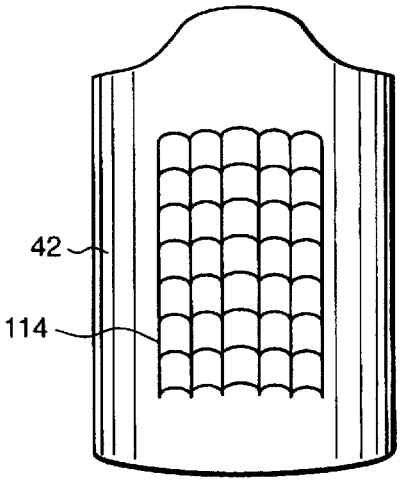

A further variation of the present invention is illustrated in FIG. 10. In this embodiment, a webbing 114 is affixed to the underside of body portion 42. Webbing 114 provides a plurality of loops to which a grappling member can be attached, thereby maximizing the likelihood of a secure contact between the grappling member and the harness assembly during the landing operation. In a preferred embodiment, webbing 114 is made from a rope-like material having a sufficient strength so as to enable a grappling member to provide a retarding force on body portion 42 via webbing 114. As with the previous embodiments, webbing 114 can be retrofitted onto an existing harness assembly.

Because the rider is typically suspended far enough above the ground so that the rider does not strike the ground during the pendulum-like swinging motion, the ride operator cannot normally manually grasp strap 72. Thus, the present invention provides a grappling member 74 having a hook 72 at an end thereof that is used by the ride operator to grasp the grappling assembly to slow the motion of rider 30 during landing. See FIG. 4.

Figure 11:
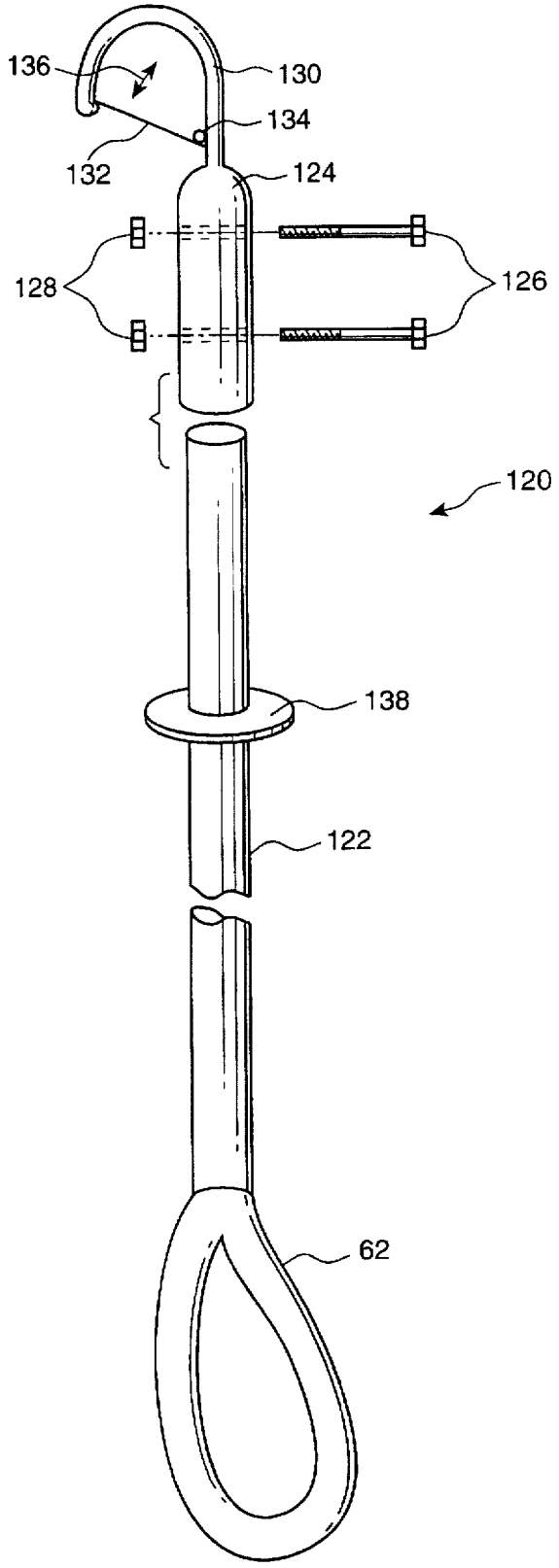
FIG. 11 is a side view of a grappling member according to the present invention.

FIG. 11 illustrates another version a grappling member 120 according to the principles of the present invention. Grappling member 120 includes a pole 122 having a hook assembly 124 attached to one end thereof. In the illustrated embodiment, nuts 126 and bolts 128 are used to attach hook assembly 124 to pole 122. Hook assembly 124 includes a hook portion 130 and a bar member 132 that selectively blocks the opening to hook portion 130.

Bar member 132 is pivotally attached to hook assembly 124 so as to be movable in the direction indicated by arrows 136. A spring 134 biases bar member 132 in a closed position illustrated in FIG. 11. Thus, when hook portion 130 is attached to the grappling assembly associated with the harness assembly, bar member 132 locks hook portion 130 in an engaged relationship with a portion of the grappling assembly so that grappling member 120 is securely affixed to the harness assembly.

Hook assembly 124 illustrated in FIG. 11 is adapted to be retrofitted onto a conventional grappling member that includes a loop 62. Thus, the same grappling member can be used to slow the motion of the rider during landing regardless of whether the rider is riding in the conventional, face down, position or in the supine position.

As shown in FIG. 11, a shock drop ring 138 surrounds pole 122. Shock drop ring 138 is made of rubber and prevents grappling member 120 and/or pole 122 from being damaged if dropped by the amusement ride operator. Shock drop ring 138 also lifts the pole off the ground far enough to enable one to easily pick the grappling member off of the ground.

Figure 12:
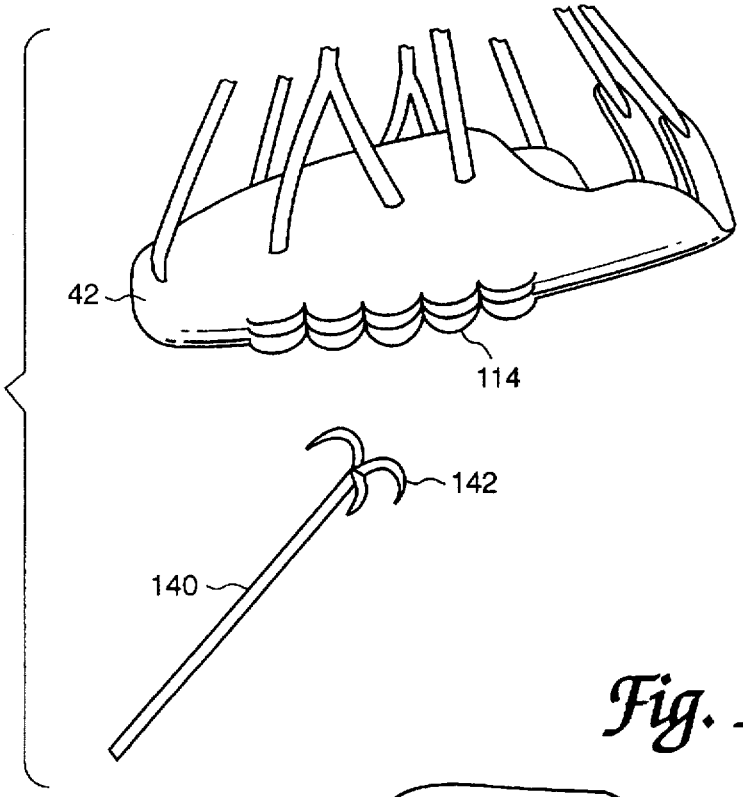
FIG. 12 is a perspective view of the harness assembly illustrated in FIG. 10 and a variation of the grappling member of FIG. 11.

In addition to the grappling member having a single hook illustrated in FIG. 11, the present invention contemplates that a plurality of hooks can be provided at the end of the grappling member for maximizing the likelihood that at least one hook will engage the grappling assembly provided on the harness assembly during the landing operation. For example, FIG. 12 illustrates a grappling member 140 having a treble hook 142 at an end thereof. FIG. 12 also illustrates the harness assembly of FIG. 10, wherein a webbing 114 is attached to body portion 42. Providing a grappling member having a plurality of hooks and a harness assembly having a plurality of grappling members capable of being grasped by the hooks, maximizes the likelihood that the amusement ride operator will securely grasp the harness assembly in a minimum number of attempts.

Figure 13:
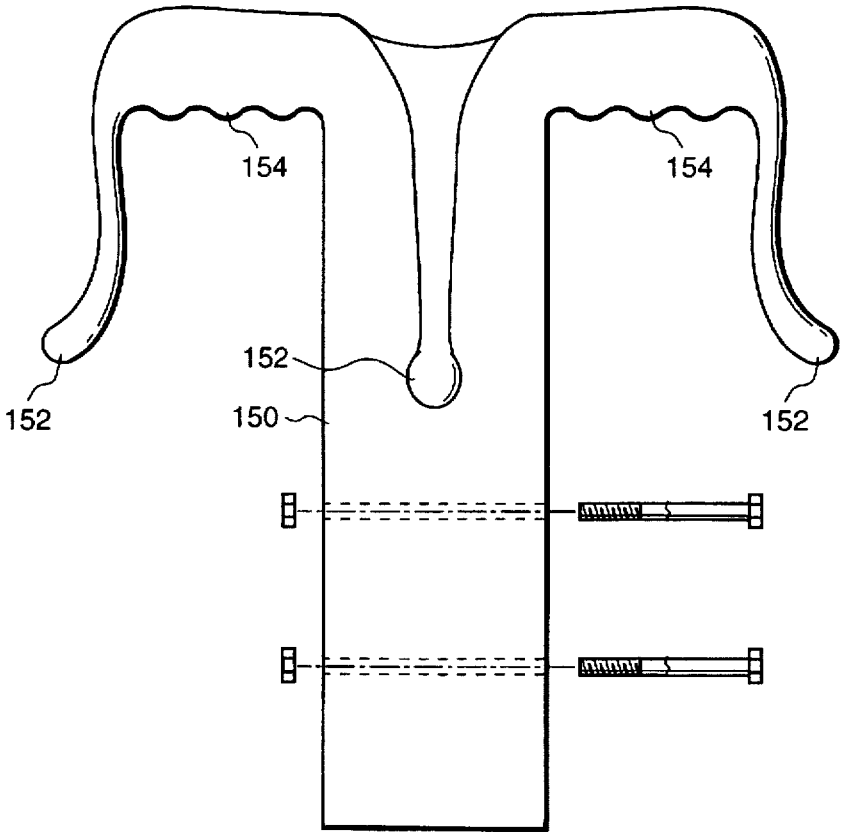
FIG. 13 is a side view of grappling hooks provided on the grappling member according to the present invention.

Yet another variation of the hook assembly that attaches to a pole in a grappling member is illustrated in FIG. 13. As in the embodiment illustrated in FIG. 12, hook assembly 150 of FIG. 13 includes a plurality of hooks 152. For example, four hooks are provided in the hook assembly (although only 3 hooks can been seen in FIG. 13 because it is a side view of the hook assembly). In this embodiment, however, a handle 154 that is sized so as to be manually gripped by the rider is provided in the crotch of each hook. Thus, this embodiment of the grappling member contemplates that the same end of the grappling member can be used to slow the motion of the rider regardless of whether the rider is in the conventional face-down position or the supine position contemplated by the present invention.

When in the conventional face-down position, the rider manually grasps handles 154 in the same manner as done with conventional loop 62 (see FIG. 3). When in the supine position, the amusement ride operator would use the same grappling member to grasp the grappling assembly provided on the harness via hooks 152. It can be appreciated that hook assembly 150 can be provided at an end of a conventional grappling pole in lieu of conventional loop 62, because hook assembly 150 accomplishes the functions of conventional loop 62, i.e., being manually grippable for slowing a rider lying in a face-down position, in addition to its grappling function for slowing down a rider lying in a supine position.

The present invention contemplates that the grappling member, including the pole and hook assembly, can be made from any material having sufficient strength to accomplish the intended result, i.e., slowing the motion of the rider by grasping the harness assembly during landing using the grappling member, while lightweight enough to be easily carried and manipulated by the ride operator. For example, both the pole and hook assembly can be made from a light, metal alloy.

When rider 30 is positioned in harness assembly 70 in the supine position illustrated in FIG. 4, a relatively large force is exerted on the rider's head. This force urges the rider's head backwards. To counteract this force and prevent undue strain or injury to the rider's neck, the present invention includes a headrest 160. See FIGS. 14 and 15. One end of headrest 160 is attached to body portion 42 and another end is attached to the straps in the support assembly 43. In particular, headrest 160 attaches to body portion 42 and shoulder straps 44. Details of headrest 160 are illustrated in FIG. 15.

Figure 15:
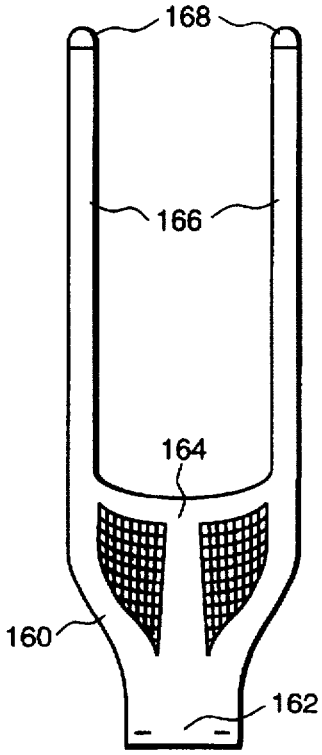
FIG. 15 is a top view of the head support member illustrated in FIG. 14.

As shown in FIG. 15, headrest 160 includes a first portion 162 that is attached to body portion 42 by, for example, being sewn thereto. It is also contemplated that headrest 160 can be removeably attached to body portion 42 by, for example, selectively engaging clasps provided at portion 162 and the associated portion of body portion 42.

A headrest support area 164 is located between portion 162 and straps 166. The distal ends 168 of straps 166, which extend from headrest area 164, attach to the straps in the harness support assembly. This attachment can be either permanent, e.g., by sewing distal ends 168 of straps 166 to shoulder straps 44, or temporary, e.g., by providing snaps or other suitable temporary fasteners at distal ends 168 of straps 166 to shoulder straps 44.

Headrest 160 can be made from any material that is strong enough to support a rider's head while being lightweight enough so as to be easily manipulated and attached to the harness assembly. In addition, headrest 160 can have a variety of shapes and be attached to harness assembly in a variety of ways and at a variety of locations so long as headrest 160 supports the rider's head during the ride and prevents the rider's head from being pulled backwards a distance that is uncomfortable to the rider.

Figure 14:
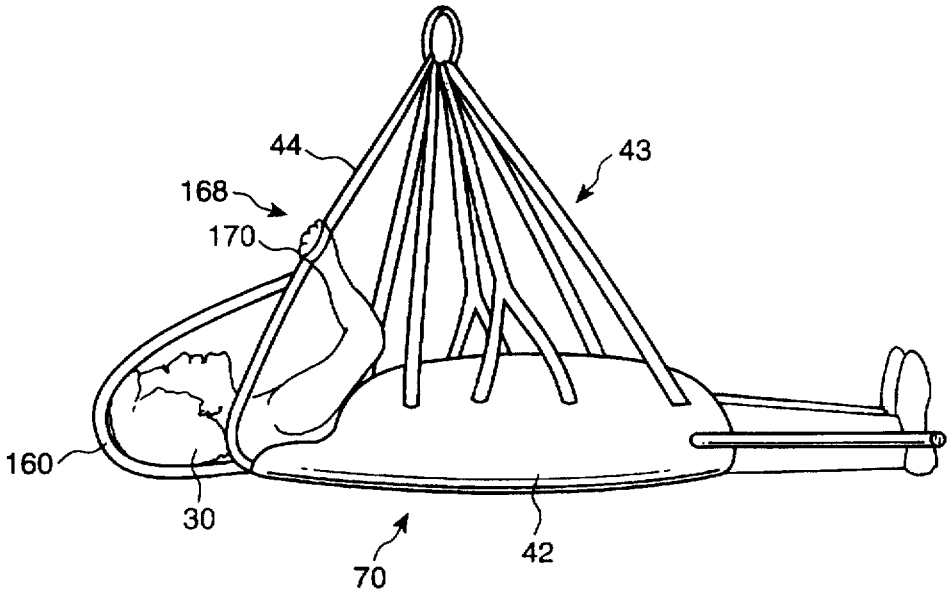
FIG. 14 is a side view illustrating a head support member coupled to a harness assembly.

It is further contemplated that gripping portions 168 can be provided on shoulder straps 44 so that rider 30 can grasp shoulder straps 44 during the ride. FIG. 14 illustrates a loop 170 attached to the shoulder strap. The user inserts his or her hand within the loop, thereby making it easier for the rider to hold on to the shoulder straps at the gripping portion thereof during the ride. This also prevents the rider from having to rely entirely on his or her own strength to keep his or her arms from being pulled backwards as gravitational forces are applied to the rider following launch.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

Thus, it is to be understood that variations in the various structures described above, their configuration and materials employed, as well as the specific shapes thereof, can be made without departing from the novel aspects of the invention as defined in the claims.

What is claimed is:

1. A harness assembly adapted to suspend at least one rider in a supine position comprising:

a body portion having a first surface, a second surface on a side thereof opposite said first surface and longitudinal edge portions, wherein said body portion is sized such that said first surface engages a substantial portion of a back of said at least one rider with said at least one rider being disposed generally between said longitudinal edge portions when said at least one rider is supported by said harness assembly;

a suspension assembly coupled to said longitudinal edge portions of said body portion; and a grappling assembly coupled to said body portion facilitating grasping of said body portion by an external grappling member.

2. A harness assembly according to claim 1, wherein said grappling assembly comprises a strap attached to said second surface of said body portion, said strap having first and second ends that are coupled to said second surface so as to define a gap between said second surface and a portion of said strap between said first and said second ends, thereby enabling said strap to be grasped by said external grappling member.

3. A harness assembly according to claim 2, wherein said first and said second ends of said strap are disposed on said body portion such that a lengthwise direction of said strap is aligned with a centerline of said body portion.

4. A harness assembly according to claim 1, wherein said grappling assembly comprises a grappling loop and an attaching assembly attached to said second surface of said body portion that couples said loop to said second surface of said body portion.

5. A harness assembly according to claim 4, wherein said attaching assembly is attached to said body portion at a centerline thereof.

6. A harness assembly according to claim 4, wherein said attaching assembly selectively couples said loop to said body portion and comprises:

an attaching loop coupled to said second surface of said body portion; and a coupling member that selectively attaches said grappling loop to said body portion via said attaching loop.

7. A harness assembly according to claim 6, wherein said coupling member is a selectively openable and closeable locking hook selectively attachable to said grappling loop and said attaching loop.

8. A harness assembly according to claim 1, wherein said grappling assembly comprises a webbing attached to said second surface of said body portion.

9. A harness assembly according to claim 1, further comprising a head support member coupled to at least one of said body portion and said suspension assembly so as to support the head of said person wearing said harness assembly.

10. A harness assembly according to claim 9, wherein said suspension assembly includes shoulder straps attached to said body portion and said head support member is a piece of material having a first portion attached to said body portion generally between said shoulder straps, a second portion and a third portion attached to respective shoulder straps such that a main support portion of said head support member, which is generally between said first, said second and said third portions, supports said person's head when said person is in a supine position in said harness assembly.

11. An amusement ride comprising:

a support structure having a suspension line pivotably attached thereto so as to suspend at least one rider such that said at least one rider swings from a distal end of said suspension line;

a harness assembly adapted to suspend said at least one rider in a supine position at said distal end of said suspension line, said harness comprising:

a body portion having a first surface, a second surface on a side thereof opposite said first surface and longitudinal edge portions, wherein said body portion is sized such that said first surface engages a substantial portion of a back of said at least one rider with said at least one rider being disposed generally between said longitudinal edge portions when said at least one rider is supported by said harness assembly;

a suspension assembly coupled to said longitudinal edge portions of said body portion; and a grappling assembly coupled to said body portion facilitating grasping of said body portion by an external grappling member; and a grappling member adapted to selectively engage at least a portion of said grappling assembly to facilitate slowing a motion of said person.

12. An amusement ride according to claim 11, wherein said grappling assembly comprises a strap attached to said second surface of said body portion, said strap having first and second ends that are coupled to said second surface so as to define a gap between said second surface and a portion of said strap between said first and said second ends, thereby enabling said strap to be grasped by said external grappling member.

13. An amusement ride according to claim 12, wherein said first and said second ends of said strap are disposed on said body portion such that a lengthwise direction of said strap is aligned with a centerline of said body portion.

14. An amusement ride according to claim 11, wherein said grappling assembly comprises a grappling loop and an attaching assembly attached to said second surface of said body portion that couples said loop to said second surface of said body portion.

15. An amusement ride according to claim 14, wherein said attaching assembly is attached to said body portion at a centerline thereof.

16. An amusement ride according to claim 14, wherein said attaching assembly selectively couples said loop to said body portion and comprises:

an attaching loop coupled to said second surface of said body portion; and a coupling member that selectively attaches said grappling loop to said body portion via said attaching loop.

17. An amusement ride according to claim 16, wherein said coupling member is a selectively openable and closeable locking hook selectively attachable to said grappling loop and said attaching loop.

18. An amusement ride according to claim 11, wherein said grappling assembly comprises a webbing attached to said second surface of said body portion.

19. An amusement ride according to claim 11, further comprising a head support member coupled to at least one of said body portion and said suspension assembly so as to support the head of said person wearing said harness assembly.

20. An amusement ride according to claim 19, wherein said suspension assembly includes shoulder straps attached to said body portion and said head support member is a piece of material having a first portion attached to said body portion generally between said shoulder straps and a second portion and a third portion attached to respective shoulder straps such that a main support portion of said head support member, which is generally between said first, said second and said third portions, supports said person's head when said person is in a supine position in said harness assembly.

21. An amusement ride according to claim 11, wherein said grappling member comprises:

a pole having a first end and a second end; and a hook portion attached to said first end of said pole, said hook portion having at least one hook adapted to engage said grappling assembly.

22. An amusement ride according to claim 21, wherein a manually grippable loop is provided at said second end of said pole.

23. An amusement ride according to claim 21, wherein said hook portion includes a spring loaded locking bar that prevents said grappling assembly from becoming disengaged from said hook once said hook engages said grappling assembly.

24. An amusement ride according to claim 21, wherein said hook portions includes a plurality of hooks, each hook in said plurality of hooks including a base and a tip and a manually grippable portion disposed between said base and said tip.

25. A harness assembly adapted to suspend at least one rider in a supine position, comprising:

a flexible body portion having a first surface, a second surface on a side thereof opposite said first surface and longitudinal edge portions, wherein said body portion is sized such that said first surface engages a substantial portion of a back of said at least one rider with said body portion being flexible enough such that said at least one rider is disposed generally between said longitudinal edge portions when said at least one rider is supported by said harness assembly;

a suspension assembly coupled to said longitudinal edge portions of said body portion; and a head support member coupled to at least one of said body portion and said suspension assembly so as to support the head of said person wearing said harness assembly, wherein said suspension assembly includes shoulder straps attached to said body portion and said head support member is a piece of material having a first portion attached to said body portion generally between said shoulder straps and a second portion and a third portion attached to respective shoulder straps such that a main support portion of said head support member, which is generally between said first, said second and said third portions, supports said person's head when said person is in a supine position in said harness assembly.

26. Method of retarding motion of at least one swinging from a support structure on a suspension line pivotably attached thereto, comprising the steps of:

providing a harness assembly adapted to suspend said at least one rider from said distal end of said suspension line, said harness assembly comprising:

a body portion having a first surface, a second surface on a side thereof opposite said first surface and longitudinal edge portions, wherein said body portion is sized such that said first surface engages a substantial portion of a back of said at least one rider with said at least one rider being disposed generally between said longitudinal edge portions when said at least one rider is supported by said harness assembly;

a suspension assembly coupled to said longitudinal edge portions of said body portion; and a grappling assembly coupled to said body portion facilitating grasping of said body portion by an external grappling member; and providing a grappling member adapted to selectively engage said grappling assembly;

coupling said grappling member to said grappling assembly; and applying a force to said harness assembly in a direction generally opposite a direction of motion of said person via said coupled engagement of said grappling member and said grappling assembly, thereby slowing said motion of said person.

* * * * *